US007753838B2

(12) United States Patent
Easter et al.

(10) Patent No.: US 7,753,838 B2
(45) Date of Patent: Jul. 13, 2010

(54) IMPLANTABLE TRANSDUCER WITH TRANSVERSE FORCE APPLICATION

(75) Inventors: James Roy Easter, Lyons, CO (US); Jose H. Bedoya, Boulder, CO (US)

(73) Assignee: Otologics, LLC, Boulder, CO (US)

( * ) Notice: Subject to any disclaimer, the term of this patent is extended or adjusted under 35 U.S.C. 154(b) by 1140 days.

(21) Appl. No.: 11/245,409

(22) Filed: Oct. 6, 2005

(65) Prior Publication Data

US 2007/0083078 A1 Apr. 12, 2007

(51) Int. Cl.
*H04R 25/00* (2006.01)

(52) U.S. Cl. ..... 600/25

(58) Field of Classification Search ..... 600/25; 607/57; 381/312; 181/129–130, 134–135
See application file for complete search history.

(56) References Cited

U.S. PATENT DOCUMENTS

| | | | | |
|---|---|---|---|---|
| 4,052,754 A | | 10/1977 | Homsy | 600/25 X |
| 4,957,478 A | | 9/1990 | Maniglia | 600/25 |
| 4,988,333 A | | 1/1991 | Engebretson et al. | 600/25 |
| 5,015,224 A | | 5/1991 | Maniglia | 600/25 |
| 5,085,628 A | | 2/1992 | Engebretson et al. | 600/25 |
| 5,277,694 A | | 1/1994 | Leysieffer et al. | 600/25 |
| 5,282,858 A | | 2/1994 | Bisch et al. | 623/10 |
| 5,324,316 A | | 6/1994 | Schulman et al. | 607/61 |
| 5,338,287 A | | 8/1994 | Miller et al. | 600/25 |
| 5,456,654 A | * | 10/1995 | Ball | 600/25 |
| 5,531,787 A | | 7/1996 | Lesinski et al. | 623/10 |
| 5,549,658 A | | 8/1996 | Shannon et al. | 607/57 |
| 5,554,096 A | | 9/1996 | Ball | 600/25 |
| 5,558,618 A | | 9/1996 | Maniglia | 600/25 |
| 5,562,716 A | | 10/1996 | Kuzma | 607/36 |
| 5,624,376 A | | 4/1997 | Ball et al. | 600/25 |
| 5,772,575 A | | 6/1998 | Lesinski et al. | 600/25 |
| 5,795,287 A | | 8/1998 | Ball et al. | 600/25 |
| 5,800,336 A | | 9/1998 | Ball et al. | 600/25 |
| 5,814,095 A | | 9/1998 | Miller et al. | 607/57 |
| 5,833,714 A | | 11/1998 | Loeb | 607/56 |
| 5,857,958 A | | 1/1999 | Ball et al. | 600/25 |
| 5,879,283 A | * | 3/1999 | Adams et al. | 600/25 |
| 5,897,486 A | | 4/1999 | Ball et al. | 600/25 |

(Continued)

FOREIGN PATENT DOCUMENTS

WO WO9806235 A1 2/1998

*Primary Examiner*—John P Lacyk
(74) *Attorney, Agent, or Firm*—Marsh Fischmann & Breyfogle LLP

(57) ABSTRACT

An implantable hearing aid transducer is provided that allows providing movement for stimulation purposes in at least first and second directions. This allows for moving an auditory component in a direction that may be substantially aligned with a natural direction of movement for the auditory component. In one arrangement, a middle ear transducer having an elongated vibratory member that extends into a patient's tympanic cavity is operative to move a tip of the vibratory member in at least first and second directions. A first direction may be along a long axis of the vibratory member while a second direction may be in a direction that is at least partially transverse to the long axis of the vibratory member. Further, the transducer may be positionable to provide alignment of the vibratory member such that the transverse direction of movement is substantially aligned with a direction of natural movement of a middle ear component (e.g. ossicles bone) to be stimulated.

26 Claims, 7 Drawing Sheets

U.S. PATENT DOCUMENTS 5,906,635 A * 5/1999 Maniglia ..... 607/57
5,913,815 A 6/1999 Ball et al. ..... 600/25
5,951,601 A 9/1999 Lesinski et al. ..... 623/10
5,957,958 A 9/1999 Schulman et al. ..... 607/56
6,190,305 B1 2/2001 Ball ..... 600/25
6,293,903 B1 9/2001 Kasic, II et al. ..... 600/25
6,475,134 B1 11/2002 Ball et al. ..... 600/25
6,537,201 B1 3/2003 Kasic, II et al. ..... 600/25
6,629,922 B1 10/2003 Puria et al.
6,676,592 B2 1/2004 Ball et al. ..... 600/25
6,705,985 B2 3/2004 Easter et al. ..... 600/25
2001/0003788 A1 6/2001 Ball et al.
2003/0065245 A1 4/2003 Easter et al.
2003/0229262 A1 12/2003 Easter et al.
2004/0258260 A1 * 12/2004 Thompson et al. ..... 381/312
2006/0008110 A1 * 1/2006 van Halteren ..... 381/417
2006/0087203 A1 * 4/2006 Cho ..... 310/353
2008/0293998 A1 * 11/2008 Andrews ..... 600/25

* cited by examiner

IMPLANTABLE TRANSDUCER WITH TRANSVERSE FORCE APPLICATION

FIELD OF THE INVENTION

The present invention relates to the field of implantable hearing devices, and more specifically to a transducer that provides mechanical stimulation to middle ear auditory components of a patient.

BACKGROUND OF THE INVENTION

In the class of hearing aid systems generally referred to as implantable hearing instruments, some or all of various hearing augmentation componentry is positioned subcutaneously on or within a patient's skull, typically at locations proximate the mastoid process. In this regard, implantable hearing instruments may be generally divided into two sub-classes, namely semi-implantable and fully implantable. In a semi-implantable hearing instrument, one or more components such as a microphone, signal processor, and transmitter may be externally located to receive, process, and inductively transmit an audio signal to implanted components such as a transducer. In a fully implantable hearing instrument, typically all of the components, e.g., the microphone, signal processor, and transducer, are located subcutaneously. In either arrangement, an implantable transducer is utilized to stimulate a component of the patient's auditory system (e.g., ossicles and/or the cochlea).

By way of example, one type of implantable transducer includes an electromechanical transducer having a magnetic coil that drives a vibratory actuator. The actuator is positioned to interface with and stimulate the ossicular chain of the patient via physical engagement. (See e.g., U.S. Pat. No. 5,702,342). Another implantable transducer utilizes implanted exciter coils to electromagnetically stimulate magnets affixed in the middle ear (See e.g., U.S. Pat. No. 5,897,486). In both arrangements, one or more bones of the ossicular chain are made to mechanically vibrate, which causes the ossicular chain to stimulate the cochlea through its natural input, the so-called oval window. For purposes hereof, electromechanical transducers capable of stimulating auditory components within the tympanic cavity, including the tympanic membrane, the ossicular chain and/or the oval window, are collectively referred to as "middle ear transducers."

Movement of the ossicular chain results in the displacement of fluid within the cochlea, which in turn results in the sensation of sound. The displacement of fluid is caused by the interaction of the innermost ossicle bone, the stapes, with the oval window, wherein the stapes functions similar to a piston moving against fluid within/behind the oval window. In a healthy ear, vibrations of the tympanic membrane cause natural movement of the ossicular chain (e.g., through the malleus, incus and stapes). This natural movement causes the stapes to move in an up-and-down manner that is substantially normal to the interface between the stapes and the oval window. This natural movement typically provides the most effective transfer of energy to the oval window. That is, the greatest hearing 'gain' is achieved by natural movement of the stapes, which is associated with natural movement of the malleus and incus. One difficulty that arises in stimulating a middle ear component with a middle ear transducer is achieving natural movement of one or more bones of the ossicular chain.

Often, a middle ear transducer mechanically vibrates the ossicular chain (i.e., in response to a transducer stimulation signal) in a non-natural direction. As may be appreciated, the utilization of an implantable middle ear transducer generally entails surgical positioning of the transducer. Such positioning may be within the mastoid process of a patient's skull and require the insertion of an elongated vibratory actuator through a hole drilled in the mastoid process. The elongated vibratory actuator may then extend into the tympanic cavity. Due to the position of the ear canal, the hole drilled through the mastoid process generally intersects the tympanic cavity in a region of the cavity where the incus and malleus are found. In this case, the elongated vibratory actuator may be coupled to one of these ossicle bones during mounting and positioning of the transducer within the patient. In one example, such coupling may occur via a small aperture formed in the incus bone.

Typically, such an elongated vibratory actuator is driven along its length to provide axial vibrations. In many instances, this 'axial' direction of movement is not aligned in the direction of natural movement of the incus and malleus. While this axial movement of the ossicular chain results in stimulation of the cochlea and the sensation of sound, the applied stimulation signal is not optimally transferred. Accordingly, enhanced hearing gain could be realized by providing more natural movement of the ossicular chain.

SUMMARY OF THE INVENTION

In order to provide more natural movement of the ossicles it may in some instances be desirable to provide a middle ear transducer that is operative to move in one or more directions (e.g., axes) that may not necessarily be aligned with the direction in which the transducer is inserted into the middle ear. For instance, in the case of a middle ear transducer where a vibratory member extends into a patient's tympanic cavity to mechanically engage an ossicle bone, it may be desirable to generate a movement of the vibratory member along a path having a displacement component that is at least partially transverse to an axis defined by the vibratory member (e.g., the insertion axis). Further, it may be desirable to generate such transverse movement in a direction that is substantially aligned with a natural direction of movement of a middle ear component (e.g. ossicles bone). Such transverse movement may permit more natural movement of a stimulated middle ear component thereby improving transfer of a stimulation signal (e.g., transducer drive signal) to the auditory system of a patient. Accordingly, the gain achieved for a transducer drive/stimulation signal may be improved.

According to a first aspect of the present invention, an implantable hearing transducer is provided that allows for providing transverse movement at a distal portion of a vibratory member that may, for example, engage the ossicular chain or other middle ear component of a patient. The transducer includes a body adapted for fixed positioning relative to a bone of a patient and a vibratory member extending from the transducer body along a first axis. The vibratory member includes a distal portion adapted for stimulating an auditory component of the patient. A driver is utilized for displacing the distal portion of the vibratory member along a movement path in response to transducer drive signals. This movement path has a displacement component that is at least partially transverse to the first axis. That is, the distal portion may in one arrangement be operable to move at an angle to the first axis. In one arrangement, the displacement component of the movement path may be selectively aligned with a desired direction of motion of an ossicle bone that is stimulated by the vibratory member. This may allow for generating more natural movement of the stimulated ossicle bone and thereby provide enhanced signal transfer/gain for a transducer drive signal.

Various refinements exist of the features noted in relation to the subject aspect of the present invention. Further features may also be incorporated in the subject aspect as well. These refinements and additional features may exist individually or in any combination. For instance, in one arrangement the transducer may also drive/displace the elongated member along the first axis for stimulation purposes. Such 'axial movement' (e.g., vibrations) may be provided alone or in conjunction with transverse movement of the distal portion of the vibratory member along the movement path having an at least partially transverse displacement component (e.g., transverse movement). The axial and transverse movements may result from the application of force to the vibratory member by a single driver or those movements may result from the application of forces by separate drivers. In any case, where the vibratory member is operative to move in axial and transverse directions, such movement in the axial and transverse directions may be based at least in part on the frequency of the transducer drive signal. For instance, enhanced signal transfer may be achieved at low frequencies using axial movement whereas transverse movement may provide enhanced signal transfer at high frequencies.

In one arrangement, the distal portion of the vibratory member is adapted for direct physical interconnection to a middle ear component. In various arrangements, the distal portion of the vibratory member may be physically connected to an ossicle bone. This physical connection may be a permanent connection or a releasable connection. For instance, for permanent connections the distal portion may be engaged within a hole formed in the ossicle bone or may be cemented to the ossicle bone. For releasable connections, the distal portion may be clipped to the ossicle bone and/or releasably engage a prosthetic component interconnected to the ossicle bone.

In another arrangement, the distal portion of the vibratory member is adapted for non-contact stimulation of a middle ear component. For instance, a magnet or coil may be interconnected to the distal portion of the vibratory member. A corresponding coil or magnet may be interconnected to a middle ear component (e.g., an ossicle bone, tympanic membrane, oval window etc). In such an arrangement, the distal portion of the vibratory member including the coil or magnet may be disposed relative to the corresponding magnet or coil interconnected to the middle ear component. The transducer may be aligned to provide, for example, transverse movement of the distal portion in a desired direction. By moving the distal portion an interconnected coil/magnet relative to the middle ear component and its interconnected magnet/coil, non-contact movement of the middle ear component may be induced.

The driver(s) may comprise any electromechanical element that is/are operative, in response to transducer drive signals, to apply a force to the vibratory member to generate a desired movement of the distal portion. In this regard, the driver may comprise, without limitation, an electric motor, an electromagnet, a piezoelectric device or a magnetostrictive device. What is important is that the driver initiates a movement (e.g., axial and/or transverse) of the vibratory member in one or more desired directions.

In one arrangement, a driver for producing transverse movement is suspended on the distal portion of the vibratory member. Excitation of this driver, for example by application of an electromagnetic field, may cause the vibratory member to deflect relative to the first axis. The stiffness of the elongated member and the size and/or mass of the suspended driver may be selected to provide a system having a desired resonant frequency. Accordingly, when the suspended driver is excited, the system may deflect thereby causing transverse movement of the distal portion of the vibratory member. In one particular arrangement, the suspended driver is a floating mass driver where a mass enclosed within the driver is excitable to produce movement.

In another arrangement, the vibratory member includes a section that is pivotally interconnected relative to the transducer body. In such an arrangement, the driver may be operative to apply a moment, or torque, to the pivotally interconnected section of the vibratory member to generate transverse movement.

According to another aspect of the present invention, a dual-motion hearing aid transducer is provided that produces movement in first and second different directions for stimulating an auditory component of a patient. The transducer includes a transducer body and a vibratory member that is movable relative to the transducer body for stimulating the auditory component. A driver is provided for selectively driving the vibratory member in first and second different movement directions in response to transducer drive signals.

In one arrangement of the current aspect, the first and second movement directions may include displacement components that are substantially transverse to one another. This may allow for aligning at least one displacement component of the movement directions with a desired direction of movement of an auditory component of the patient. The driver may drive the vibratory member in the first and second directions simultaneously and/or individually.

In another arrangement, the vibratory member comprises an elongated actuator that extends from the transducer and includes a distal portion adapted for stimulating an auditory component. In this arrangement, the long axis of the vibratory member defines the first movement direction and the second movement direction may be defined by a movement path having a displacement component that is at least partially transverse to the first movement direction. However, movement (e.g., vibration) may be selectively limited to a single direction. For instance, movement may be limited to a direction that more closely aligns with a natural direction of movement of the ossicle bone.

The transducer body of the dual-motion transducer may be fixed relative to patient tissue (e.g., a patient's skull). In this regard, the vibratory member may extend between the transducer body and a middle ear component to be stimulated. In a further arrangement, the transducer body may also be affixed to a middle ear component of the patient. For instance, the transducer body may be affixed to an ossicle bone of the patient.

According to another aspect of the present invention, a method for stimulating an auditory component of a patient is provided. The method includes advancing a vibratory member to a position relative to an auditory component of a patient. A movement path of the vibratory member is then aligned with a desired direction of movement of the auditory component. Generally, the movement path of the vibratory member includes a displacement component that is at least partially transverse to a direction of insertion for the vibratory member. Once the movement path is aligned, the vibratory member may be driven along the movement path to stimulate the auditory component of the patient.

Various refinements exist of the features noted in relation to the subject aspect of the present invention. Further features may also be incorporated in the subject aspect as well. For instance, the method may also include interconnecting the vibratory member to the auditory component. Alternatively, the method may include magnetically coupling the vibratory member to the auditory component.

According to another aspect of the present invention, a method for implanting a hearing aid transducer within a patient is provided. The method includes the step of mounting a transducer body subcutaneously within the patient. A distal portion of a vibratory member extending from the transducer body is positioned relative to a middle ear component. This vibratory member defines a first axis and the distal portion is movable along a movement path that is at least partially transverse to the first axis. The method further includes rotating the transducer body to at least partially align the movement path with a desired direction of movement of the middle ear component. The transducer body is then secured to maintain the movement path in alignment with the desired direction of movement of the middle ear component.

Various refinements exist of the features noted in relation to the subject aspect of the present invention. Further features may also be incorporated in the subject aspect as well. For instance, the method may also include physically coupling the vibratory member to the auditory component. Alternatively, the method may include magnetically coupling the vibratory member to the auditory component. In this latter regard, the method may further include attaching a magnet or a coil to the distal portion of the vibratory member and attaching a corresponding coil or magnet to the middle ear component. In this case the distal end of the elongated member may be disposed in a predetermined spaced relationship with the middle ear component.

The method may further include receiving transducer drive signals and selectively initiating movement along the first axis and/or the movement path. Selection of such movement may be based at least in part on a frequency of the transducer drive signals.

According to a further aspect the present invention, a hearing aid is provided for stimulating a middle ear component that includes an acoustic signal receiver for receiving acoustic sound and generating an acoustic response signal. The hearing aid also includes a signal processor to process the acoustic response signal and generate a transducer drive signal. An implantable transducer that is adapted to stimulate a middle ear component receives the transducer drive signal. The transducer is operative to move in at least first and second directions in response to the transducer drive signals. Preferably, a direction of movement of the transducer may be at least partially aligned with a direction of natural movement of the middle ear component.

DETAILED DESCRIPTION OF THE INVENTION

Reference will now be made to the accompanying drawings, which at least assist in illustrating the various pertinent features of the present invention. In this regard, the following description of a hearing instrument is presented for purposes of illustration and description. Furthermore, the description is not intended to limit the invention to the form disclosed herein. Consequently, variations and modifications commensurate with the following teachings, and skill and knowledge of the relevant art, are within the scope of the present invention. The embodiments described herein are further intended to explain the best modes known of practicing the invention and to enable others skilled in the art to utilize the invention in such, or other embodiments and with various modifications required by the particular application(s) or use(s) of the present invention.

Figure 1:
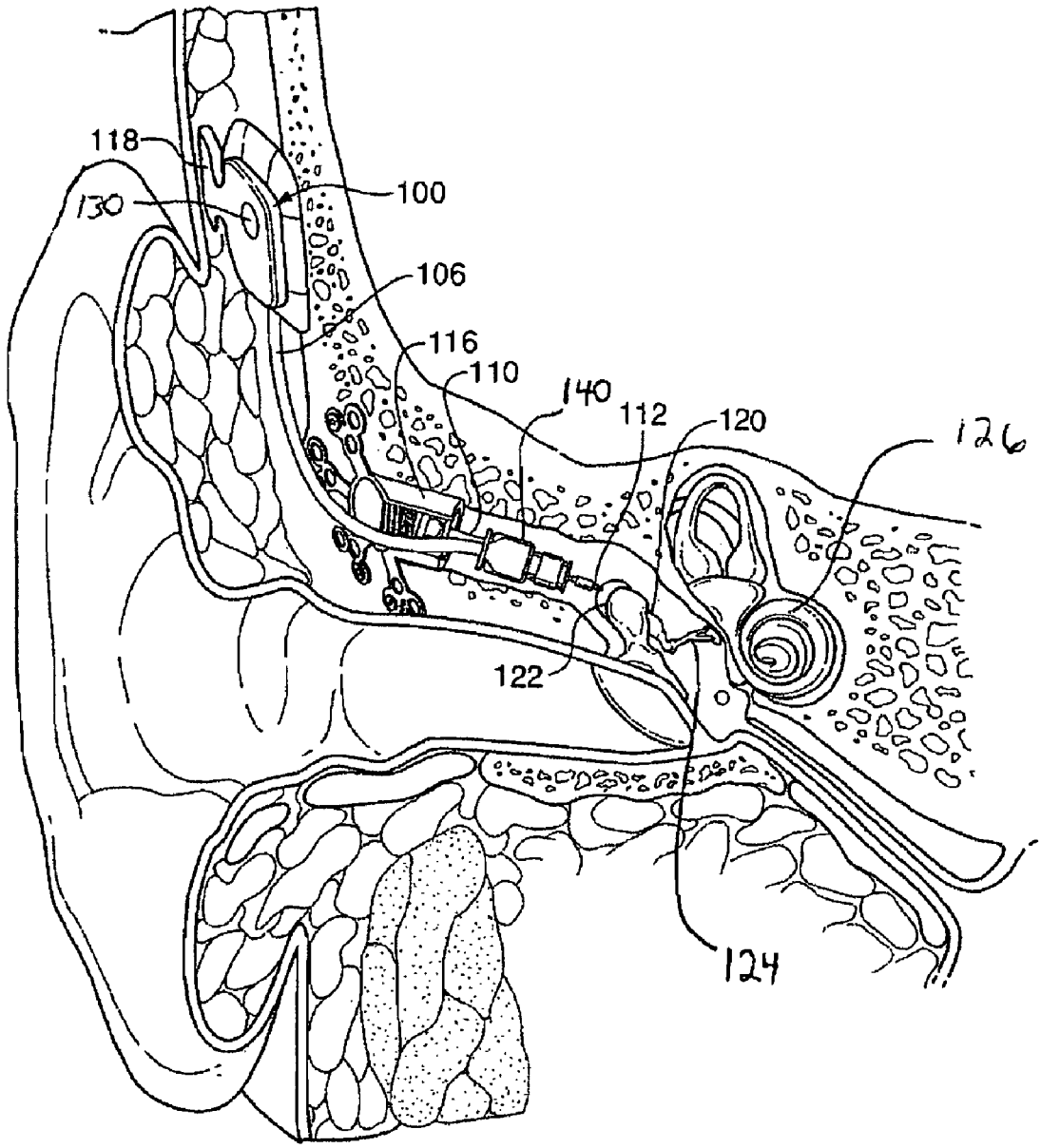
FIG. 1 illustrates a fully implantable hearing instrument as implanted in a wearer's skull.

Hearing Instrument System:

FIG. 1 illustrates one application of the present invention. As illustrated, the application comprises a fully implantable hearing instrument system. As will be appreciated, certain aspects of the present invention may be employed in conjunction with semi-implantable hearing instruments as well and, therefore, the illustrated application is for purposes of illustration and not limitation.

In the illustrated system, a biocompatible implant housing 100 is located subcutaneously on a patient's skull. The implant housing 100 includes a signal receiver 118 (e.g., comprising a coil element) and a microphone 130 that is positioned to receive acoustic signals through overlying tissue. The implant housing 100 may be utilized to house a number of components of the fully implantable hearing instrument. For instance, the implant housing 100 may house an energy storage device, a microphone transducer, and a signal processor. Various additional processing logic and/or circuitry components may also be included in the implant housing 100 as a matter of design choice. Typically, the signal processor within the implant housing 100 is electrically interconnected via wire 106 to an electromechanical transducer 140.

The transducer 140 is supportably connected to a positioning system 110, which in turn, is connected to a bone anchor 116 mounted within the patient's mastoid process (e.g., via a hole drilled through the skull). The transducer 140 includes a connection apparatus 112 for connecting the transducer 140 to the ossicles 120 of the patient. In a connected state, the connection apparatus 112 provides a communication path for acoustic stimulation of the ossicles 120, e.g., through transmission of vibrations to the incus 122.

During normal operation, acoustic signals are received subcutaneously at the microphone 130. Upon receipt of the acoustic signals, a signal processor within the implant housing 100 processes the signals to provide a processed audio drive signal (e.g., a transducer drive signal) via wire 106 to the transducer 140. As will be appreciated, the signal processor may utilize digital processing techniques to provide frequency shaping, amplification, compression, and other signal conditioning, including conditioning based on patient-specific fitting parameters. The audio drive signal causes the transducer 140 to transmit vibrations at acoustic frequencies to the connection apparatus 112 to effect the desired sound sensation via mechanical stimulation of the incus 122 of the patient. These vibrations are then transmitted from the incus 122 to the stapes 124, effecting a stimulation of the cochlea 126.

To power the fully implantable hearing instrument system of FIG. 1, an external charger (not shown) may be utilized to transcutaneously re-charge an energy storage device within the implant housing 100. In this regard, the external charger may be configured for disposition behind the ear of the implant wearer in alignment with the implant housing 100. The external charger and the implant housing 100 may each include one or more magnets to facilitate retentive juxtaposed positioning. Such an external charger may include a power source and a transmitter that is operative to transcutaneously transmit, for example, RF signals to the signal receiver 118. In this regard, the signal receiver 118 may also include, for example, rectifying circuitry to convert a received signal into an electrical signal for use in charging the energy storage device. In addition to being operative to recharge the on-board energy storage device, such an external charger may also provide program instructions to the processor of the fully implantable hearing instrument system.

Figure 2:
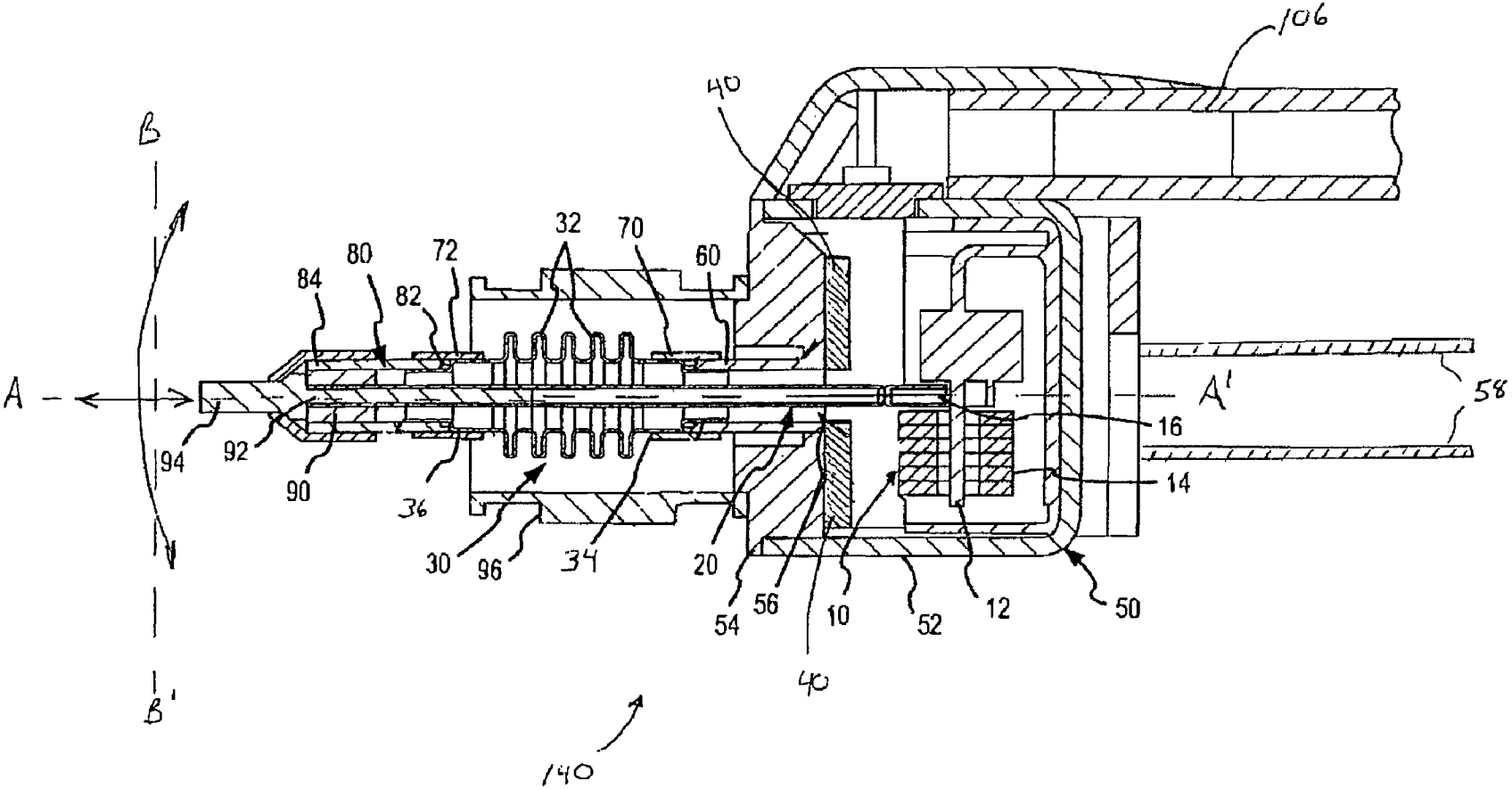
FIG. 2 shows a cross-sectional view of a first embodiment of a transverse movement transducer.

Transverse Force Transducer:

As shown in FIG. 2, the electromechanical transducer 140 includes vibratory member 20 having a proximal end interconnected to a driver 10 disposed within a transducer housing 50 and a distal end that extends away from the transducer housing 50. A hollow bellows 30 is interconnected to a distal end of the vibratory member 20 and extends to the transducer housing 50. In use, the distal end of vibratory member 20 may be positioned within the middle ear of a patient to stimulate the ossicular chain. The long axis of the vibratory member 20, which in the embodiment shown is also the long axis of the transducer 140, defines a first axis A-A'. The transducer 140 may selectively induce vibrations of vibratory member 20 in one or more directions as will be more fully discussed herein. Such vibrations are in turn communicated to the ossicular chain to yield enhanced hearing.

The bellows 30 comprise a plurality of undulations 32 that allow the bellows 30 to respond in an accordion-like fashion to vibrations of the vibratory member 20. For instance, during axial movement of the vibratory member 20 the bellows 30 may expand and contract linearly. During angular movement of the vibratory member 20 (i.e., movement transverse to the long axis A-A') one portion of the bellows 30 may contract while an opposing portion expands. Of note, bellows 30 is sealed to provide for isolation of the internal componentry of transducer 140. Generally, the elongated vibratory member 20 and bellows 30 form the elongated connection apparatus 112 of FIG. 1. This connection apparatus 112 extends from the transducer to allow distal end 92 of the vibratory member 20 to stimulate an auditory component of the patient.

Referring to FIGS. 1 and 2, the transducer 140 shown generally includes the housing 50, comprising a welded main body member 52 and a lid-housing member 54. An elongated proximal member 58 is interconnected to the proximal end of the housing 50. In the present embodiment, member 58 interconnects the transducer 140 to the positioning mechanism 110. In order to affect the communication of vibrations to an auditory component of the patient, vibratory member 20 passes through an opening 56 of the lid-housing member 54 and extends through the bellows 30 to the distal end of the bellows for interconnection therewith. To maintain isolation of components within the housing 50 (e.g., vibratory member drivers 10, 40), the bellows 30 is hermetically sealed and hermetically interconnected to the housing 50 at its proximal end 34. Likewise the distal end 36 of the bellows 30 is hermetically interconnected to the distal end of the vibratory member 20. A bellows guard 96 may be positioned about the bellows 30 and interconnected to the housing member 52 at its proximal end. Of note, a distal end of the bellows guard 96 may be open such that the bellows 30 and vibratory member 20 may deflect angularly in a direction that is at least partially transverse to axis A-A'.

A portion of the proximal end 34 of the bellows 30 is slidably and intimately disposed within a cylindrical distal end of a sleeve 60, which is received within the opening 56 of the lid housing member 54. An overlapping layer 70 (e.g., comprising a biocompatible material such as gold) may be disposed across and about the abutment region for interconnection and sealing purposes. Similarly, a distal sleeve 80 may be slidably and intimately disposed about a portion of the distal end 36 of bellows 30. Again, an overlapping electrodeposited layer 72 (e.g., comprising a biocompatible material such as gold) may be provided across and about the abutment region for interconnection and sealing purposes.

In the illustrated embodiment, a cylindrical distal end 84 of distal sleeve 80 receives a cylindrical bushing 90, which locates the distal end 92 of the vibratory member 20 therewithin. As further shown, the distal end 92 of the vibratory member may be interconnected (e.g., welded) to an actuator tip member 94. The tip member 94 may be particularly adapted for tissue attachment with the ossicular chain of a patient. In this regard, the tip member 94 may be advanced into a shallow opening defined within one of the ossicle bones (e.g., an opening defined in the incus via laser ablation). Accordingly, the tip member may include one or more mechanisms that are designed to maintain the tip member within such a hole. Exemplary connection devices are set forth in U.S. patent application Ser. No. 10/394,499 filed on Mar. 20, 2003 and entitled "Improved Apparatus and Method For Ossicular Fixation of Implantable Hearing Aid Actuator," the contents of which are incorporated by reference herein. Though discussed in one arrangement utilizing a shallow opening into which the tip member 94 may be disposed, it will be appreciated that attachment of the tip member 94 may be connected to an auditory component through a variety of other attaching means/mechanisms. For instance, the distal end 92 and/or tip member 94 of the vibratory member 20 may be cemented to an ossicle. Or, the distal end 92 of the vibratory member 20 may be attached to an ossicle by a releasable clip.

To effectuate movement of the vibratory member in two separate directions, the transducer 140 of the present arrangement utilizes first and second electromagnetic drivers 10 and 40. As shown, the first electromechanical driver 10 provides axial movement of the vibratory member 20 (i.e., along the long axis A-A' of vibratory member 20) while the second electromagnetic driver 40 provides movement of the vibratory member along a movement path B-B' that includes a displacement component that is at least partially transverse to the long axis A-A' of vibratory member 20.

The first electromechanical driver 10 comprises a leaf 12 extending through a plurality of coils 14. Coils 14 may be electrically interconnected to the wire 106, which provides signals that induce a desired magnetic field across coils 14 so as to affect desired movement of leaf 12. In the illustrated embodiment, leaf 12 is connected to a stiff wire 16, and vibratory member 20 is crimped onto the wire 16. As such, movement of leaf 12 effects axial vibration of vibratory member 20 along axis A-A'.

The second electromagnetic driver 40 comprises an electromagnetic motor that may be electrically interconnected to the wire 106 and which provides signals that induce a desired magnetic field. The wire 106 may consist of two separate conductors for each of the drivers 10 and 40, or the drivers 10, 40 may share a common ground conductor. Additionally, it should be noted that a frequency-selective filter may be interposed between each of the drivers 10 and 40 and its respective conductor, so as to power each driver 10, 40 with a selected range of frequencies. Alternatively, the frequency-selective filter or filters may be located within the implant housing 100.

When actuated, the second electromagnetic driver 40 may deflect the vibratory member 20 relative to axis A-A'. Accordingly, the tip 94 of the vibratory member 20 may be deflected along a movement path B-B' having a component that is transverse to axis A-A'. Specifically, the tip 94 may move along a generally arcuate path B-B'. Of note, the cross-sectional dimensions of the vibratory member 20 may permit deflection in a first direction while resisting deflection in another direction. For example, the vibratory member 20 may have a rectangular cross-section that permits deflection about a short dimension of the rectangular cross-section while resisting deflection about a long dimension of the rectangular cross-section. The first and second drivers 10, 40 may be operated such that the tip 94 may be moved along axis A-A' and along movement path B-B' simultaneously.

As illustrated in FIG. 1, the implantable hearing system is positioned within the mastoid process of a patient's skull. Specifically, a hole is drilled into the mastoid process into which the transducer 140 is disposed. Due to the position of the ear canal, the hole drilled through the mastoid process generally intersects the tympanic cavity in a region of the cavity where the incus and malleus are formed. Accordingly, the transducer 140 may be interconnected to the incus 122 to provide vibrations thereto. Heretofore, applications of vibrations to the incus by the transducer 140 have been limited to axial vibrations along axis A-A' of the transducer 140/vibratory member 20.

Providing such axial vibration to the incus 122 often results movement of the incus 122 that is not necessarily aligned with a direction of natural movement. Accordingly, the movement of the vibratory member 20, which corresponds to transducer drive signals, has in some previous instances not been efficiently transferred to the stapes 124 and hence the cochlea 126. The natural movement of the incus 122 at the illustrated point of connection may be more of a side-to-side movement (e.g., perpendicular to the surface of the paper) that is at least partially transverse to axis A-A' of the transducer 140. Accordingly, enhanced transfer of vibratory energy may be achieved by moving the incus 122 in a direction that is at least partially transverse to axis A-A' of the transducer 140/vibratory member 20.

The transducer 140 as shown in FIG. 2 allows for applying transverse force to the incus 122 (or another ossicle bone) along movement path B-B', which includes a displacement component that is at least partially transverse to axis A-A', such that a more natural movement of the incus 122 may be achieved. To allow for the transducer 140 to provide natural movement to the incus 122, the movement path B-B' may be aligned with a defined direction of movement for the incus 122. In this regard, the transducer 140 may be advanced towards the incus 122 until the tip 94 engages the incus 122. See FIGS. 1 and 2. For instance, the tip 94 may engage a laser-ablated hole within the incus 122. Once so engaged, the transducer 140 may be rotated such that the movement path B-B' is aligned with desired direction of movement for the incus 122. Once the transverse axis B-B' is aligned with the desired direction of movement, the transducer 140 may be locked in position utilizing the positioning system 110. Accordingly, transducer drive signals may be more effectively transferred to the stapes 124, the oval window and hence the cochlea 126, thereby increasing the hearing gain perceived by the patient.

Alternatively, or in addition, transducer drive signals may also be transferred along axis A-A' (e.g., represented as axial vibrations). Such transmission of axial vibrations to the ossicle(s) may be done in conjunction with vibration/movement along path B-B' (i.e., transverse movement/vibration). Further, axial vibrations and transverse vibrations may be selectively utilized depending on the transducer drive signals received. For instance, axial vibrations may be provided for lower frequency signals while transverse vibrations may be provided for higher frequency signals. In this regard, axial forces may produce a preferentially high force at lower frequencies and transverse vibrations may provide preferentially high forces at higher vibrations. Accordingly, by utilizing the two drivers 10, 40 transducer drive signals may be transmitted across a wide range of frequencies, which permit use of implantable hearing system with a greater range of patients. As will be appreciated, selective use of axial or transverse vibrations for specific frequencies may be determined on a patient by a patient basis during a fitting procedure.

Utilizing transverse vibration(s) may also allow for a reduction of feedback vibrations through the patient's skull. That is, applying transverse vibrations to the ossicle may have the additional advantage of permitting a desirable isolation of force from the transducer 140 to the skull. By selecting the components of the transducer 140 and positioning system 110 to have certain mechanical characteristics it is possible to limit the force transmitted to the skull by operation of the transducer 140. For example, if the transverse spring rate, or resistance of the vibratory member 20 to transverse movement, is small, the resulting resonant frequency for the system comprising the transducer and ossicles will be correspondingly low. Such a low resonant frequency for the excited system has the property of reducing the force reflected to the positioning system 110. Reducing the force transmitted to the positioning system 110 in turn reduces the intensity of feedback that may be detected by an implanted microphone, and thus permits a greater degree of stimulation signal amplification without unwanted feedback.

Figure 3A:
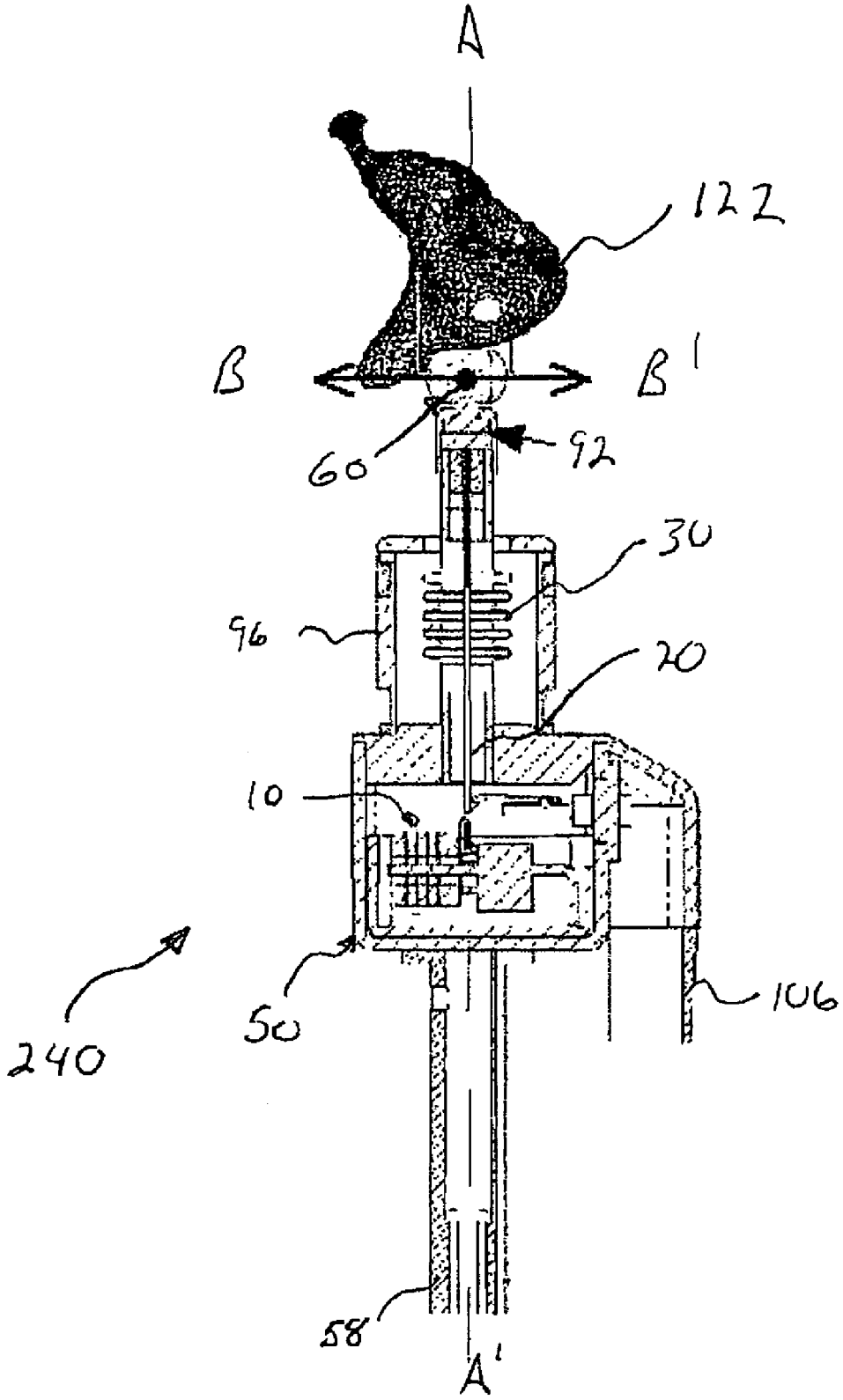
FIG. 3A shows a cross-sectional view of a second embodiment of a transverse movement transducer.
Figure 3B:
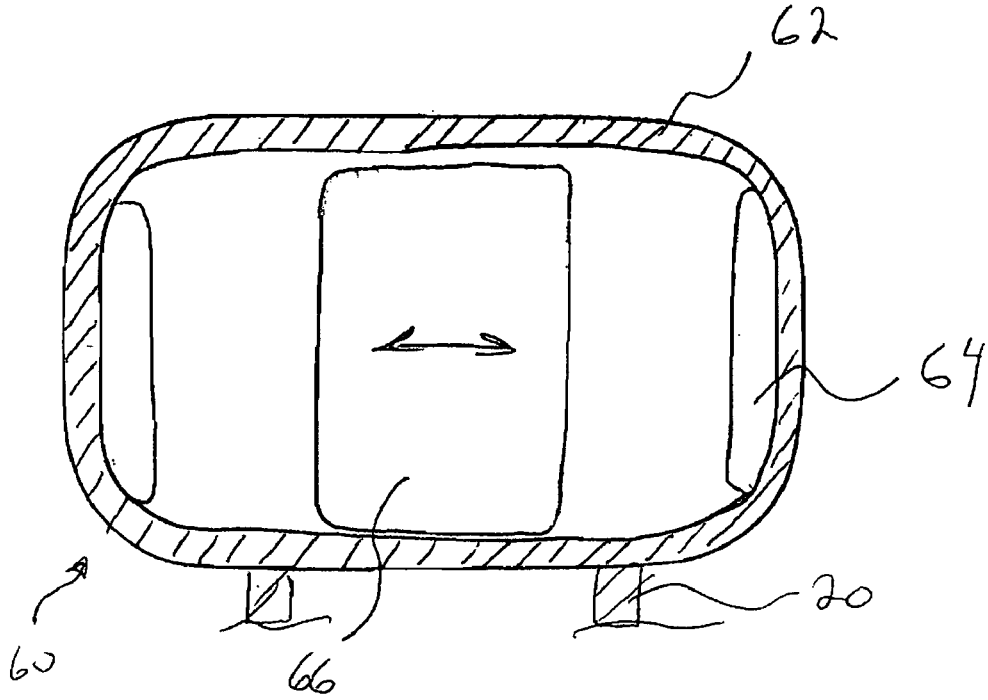
FIGS. 3B and 3C show a cross-sectional view of alternate drivers utilized with the transducer of FIG. 3A.
Figure 3C:
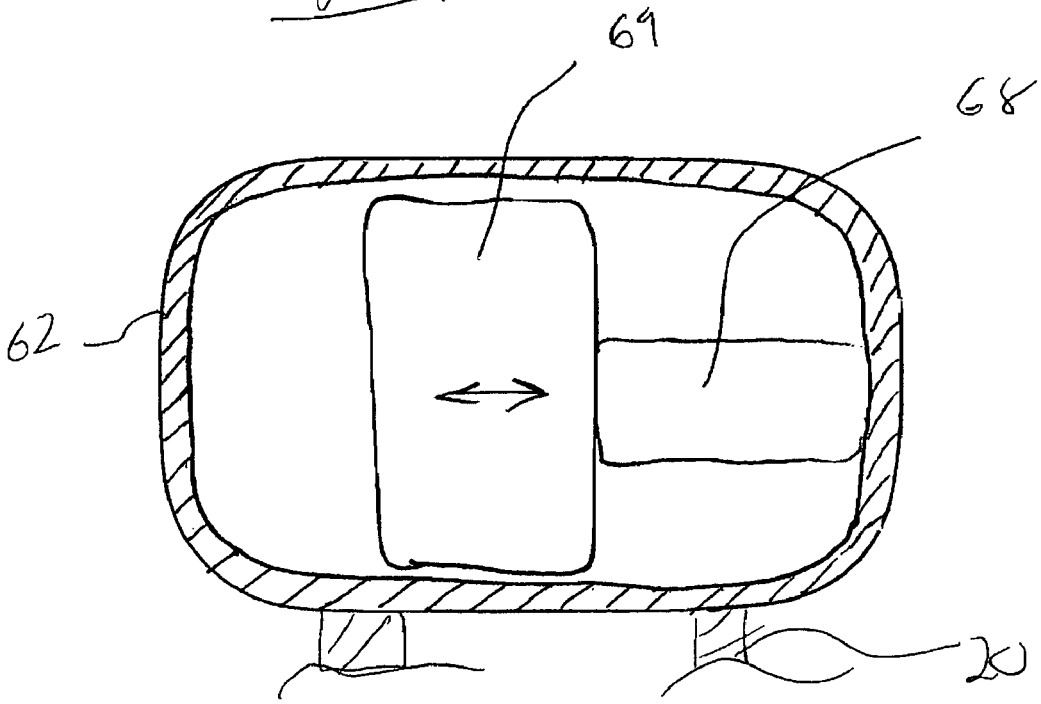
Figure 4:
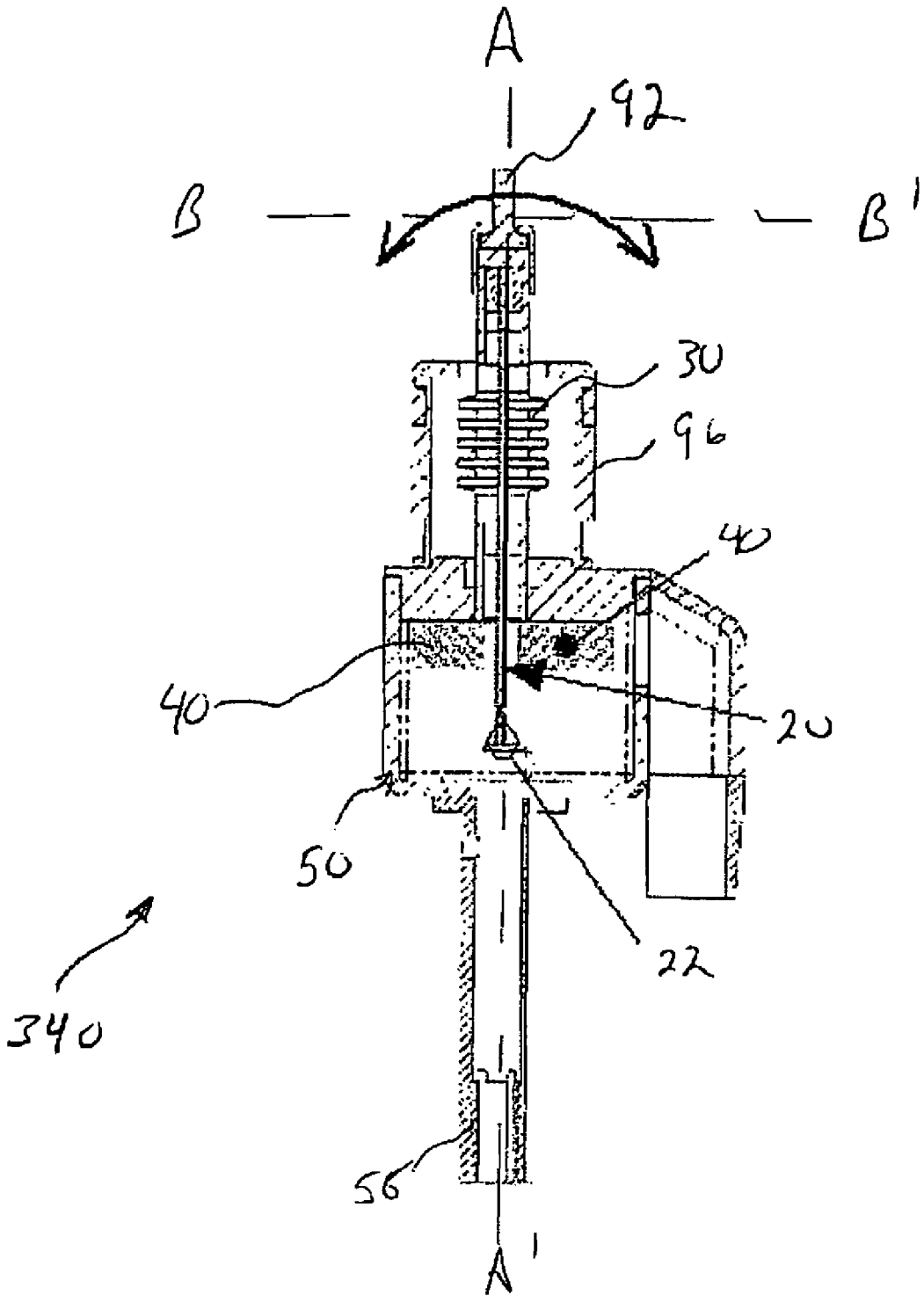
FIG. 4 shows a cross-sectional view of a third embodiment of a transverse movement transducer.
Figure 5:
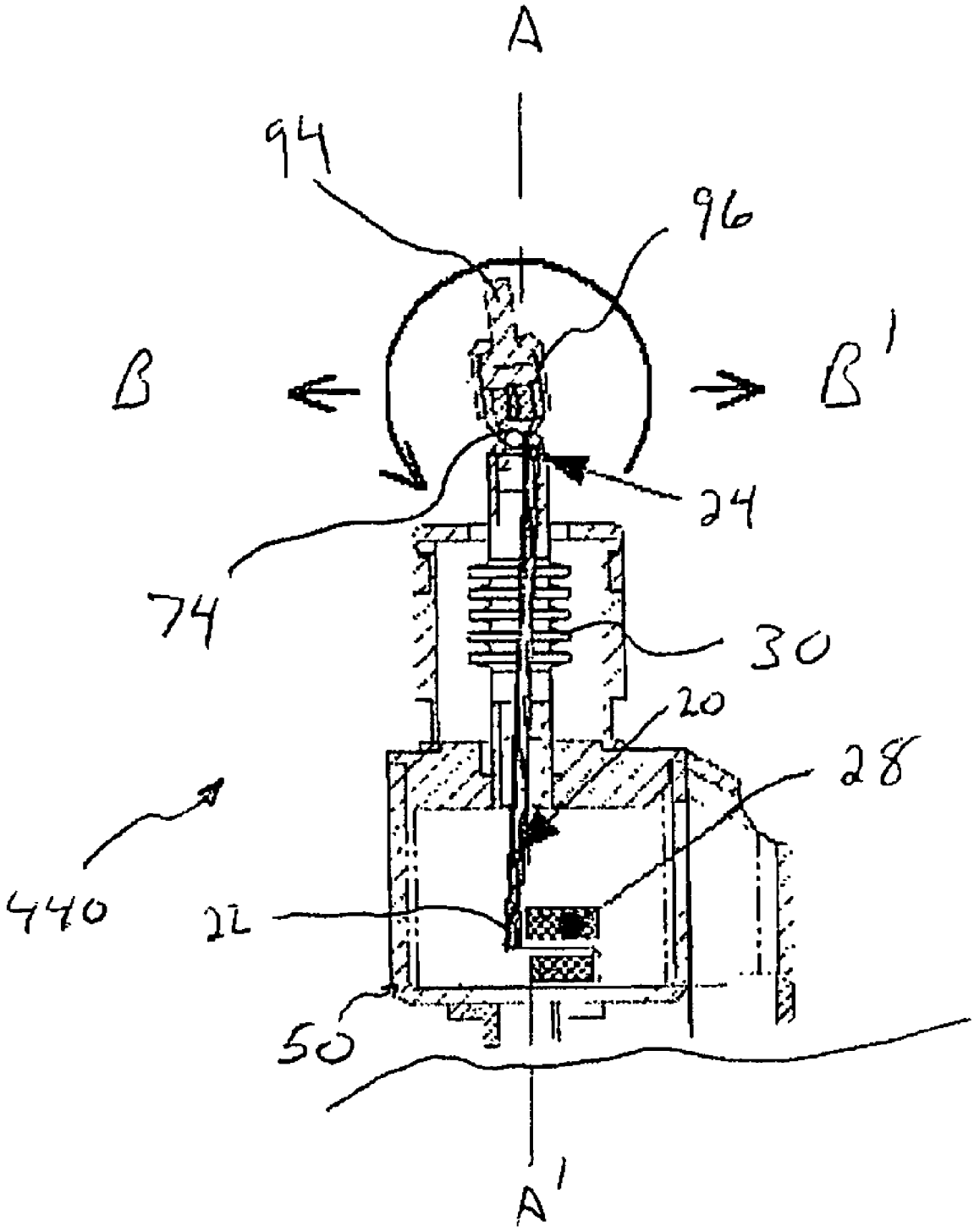
FIG. 5 shows a cross-sectional view of a fourth embodiment of a transverse movement transducer.

FIGS. 3-5 illustrate additional embodiments of transverse force transducers 240, 340 and 440 that may be utilized to apply a transverse force to an auditory component of a patient. The transducers 240, 340, 440 are each similar to the transducer 140 of FIG. 2. Accordingly, like elements contain common reference numbers.

As shown in FIG. 3, the transducer 240 utilizes a first driver 10 to provide axial vibrations to the vibratory member 20. Disposed on the distal end 92 of the vibratory member 20 is a second suspended driver 60. The suspended driver 60 is adapted to generate inertial movement at the end of the elongated member 20 and, hence, movement transverse to axis A-A'. The suspended driver 60 is interconnected to the incus 122 utilizing a clip arrangement. In this regard, the transducer 240 is removably interconnected to the incus 122. Though discussed as utilizing a removable interconnection, it will be appreciated that the transducer 240 utilizing the suspended driver 60 may also utilize other interconnection techniques/mechanisms.

Axial movement of the vibratory member 20 caused by the first driver 10 produces movement of the incus along axis A-A'. Movement by the second driver 60 causes an inertial reaction at the tip of the elongated member 20 that results in a deflection of the bellows 30 and vibratory member 20. Deflection may generally be along movement path B-B', which is generally transverse to axis A-A'. By selecting components of the transducer 240 to have certain mechanical characteristics, it is possible to achieve a low resonant frequency for the suspended driver system. For instance, if the transverse spring rate (i.e. of the bellows 30 and/or vibratory member 20), or resistance of the transducer to transverse force is small, the resulting resonant frequency of the system comprising the transducer and ossicles will be correspondingly small. Such a low resonant frequency for the excited system has the property of reducing the force reflected to the mounting element. Accordingly, less feedback is received by, for example, an implanted microphone. Stated otherwise, application of transverse force to the ossicles by the suspended driver 60 may isolate vibrations from the positioning system 110 and bone anchor 116 (see FIG. 1) thereby attenuating/preventing transfer of these vibrations to the microphone 130.

FIGS. 3A and 38 illustrate first and second embodiments of the suspended driver 60. As shown in FIG. 3B, the suspended driver 60 includes an outer casing 62 that defines interior volume in which a floating mass is contained. More specifically, a magnet 66 is disposed within the casing 62 that may be selectively displaced. In this regard, at least the first coil 64 is incorporated into the housing 62 for attracting and or repelling the magnet 66. Accordingly, wiring (not shown) may be interconnected to the coil(s) 64 to allow for selective application of a transducer drive signal(s). Any case, movement of the magnet 66 within the interior volume of the casing 62 results in an inertial displacement at the end of the elongated member 20.

In the embodiment shown if FIG. 3B, the suspended driver 60 again includes an outer casing that defines interior volume in which a mass is contained for producing inertial displacement of the elongated member 20. However, in this embodiment the mass 69 is interconnected to the casing 62 by an electromechanical element that is operative to physically move the mass 69 relative to the casing 62. In the present embodiment, the mass 69 is interconnected to the casing 62 by a piezoelectric element 68 that is operative to expand and contract in response to applied transducer drive signals.

In the embodiment shown in FIG. 4, the transducer 340 utilizes a single electromagnetic driver 40 for applying transverse force to the vibratory member 20. A proximal end 22 of the vibratory member 20 is interconnected to the transducer housing 50. Application of the transverse force in conjunction with the fixed proximal end of the vibratory member results in an arcuate movement of the distal end 92 of the vibratory member 20. This arcuate movement may be generally along movement path B-B'. In the embodiment shown the transducer of FIG. 4 is limited to providing transverse movement at the tip 92. That is, the transducer 340 does not provide axial vibration.

FIG. 5 illustrates a further embodiment of a transverse force transducer 440. As shown, the transducer 440 includes a movable/pivotal section 96 interconnected to the end of the bellows 30. More particularly, a hinge member 74 interconnects the pivotal section 96 to the bellows 30. The pivotal section 96 includes the actuator tip member 94 for engaging or otherwise stimulating an auditory component. This hinge member 74 defines an axis that is substantially normal to the long axis A-A' of the transducer 440. In this embodiment, the vibratory member 20 comprises an eccentric rod having a distal end 24 that that applies a force to the pivotal end section at a point displaced from the hinge member 74. A proximal end 22 of the vibratory member is connected to a motor 28 that is operative to displace the eccentric rod. This results in the creation of a moment force about the hinge member 74, and hence displacement of the tip 94 along a path B-B' that is at least partially transverse to axis A-A'.

Figure 6:
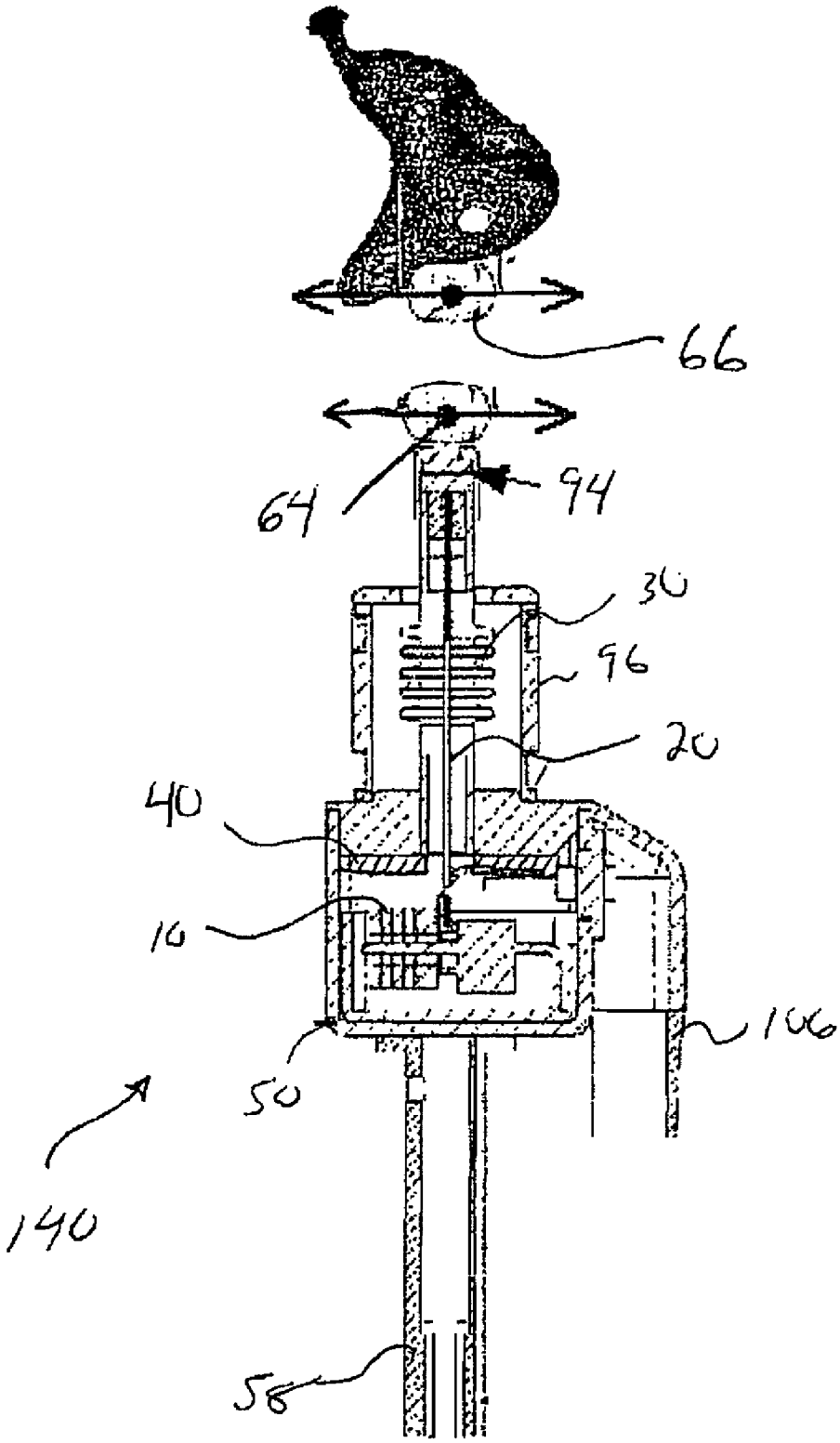
FIG. 6 shows a cross-sectional view of a transverse movement transducer adapted for non-contact engagement.

FIG. 6 shows a further embodiment of the present invention wherein the transducer 140 of FIG. 2 is utilized in conjunction with a floating mass transducer. In this regard, an electrical coil 64 is interconnected to the tip member 94 of the transducer 140. A magnet 66 is interconnected to an ossicle bone (e.g., the long process of the incus). In use, the tip member 94 and the interconnected coil 64 are disposed in a spaced relationship with the magnet 66. The coil 64 may then be vibrated along axis A-A' and/or along movement path B-B'. The electromagnetic field generated by the coil 64 in conjunction with the vibratory motion in one or more directions causes the magnet 66 to move, thereby stimulating the patient's ossicles.

Those skilled in the art will appreciate variations of the above-described embodiments that fall within the scope of the invention. As a result, the invention is not limited to the specific examples and illustrations discussed above, but only by the following claims and their equivalents.

What is claimed:

1. An implantable hearing aid transducer, comprising:

a transducer body adapted for fixed positioning relative to a skull of a patient;

an elongated vibratory member extending from the transducer body along a long axis of said elongated vibratory member and having a distal end portion for stimulating an auditory component;

a first driver for displacing said distal end portion of said elongated vibratory member along a first movement path in response to transducer drive signals, wherein said first movement path has a displacement component that is at least partially transverse to said long axis of said elongated vibratory member; and a second driver for displacing said elongated vibratory member along a second movement path that is substantially aligned with said long axis.

2. The transducer of claim 1, wherein said first and second drivers are operative to displace said distal end portion along said first and second movement paths simultaneously.

3. The transducer of claim 1, wherein said first and second drivers are operative to selectively displace said distal end portion along a selected one of said first and second movement paths based on a frequency of said transducer drive signal.

4. The transducer of claim 1, wherein the transducer body includes an aperture extending through at least a first side thereof, and wherein the elongated vibratory member extends through said aperture.

5. The transducer of claim 1, wherein said distal end portion of said elongated vibratory member is adapted for physical interconnection to a middle ear component.

6. The transducer of claim 1, wherein said first driver is disposed proximate to said distal end portion of said elongated vibratory member.

7. The transducer of claim 6, wherein a resonant frequency of said elongated vibratory member and said first driver is less than about 2000 Hz.

8. The transducer of claim 6, wherein said first driver comprises a floating mass for producing inertial reactions to said distal end portion of said elongated vibratory member.

9. The transducer of claim 1, wherein said first driver applies a force to said elongated vibratory member at a location within said transducer body, wherein said force is applied in a direction that is at least partially transverse to said long axis of said elongated vibratory member.

10. The transducer of claim 1, wherein said vibratory member further includes:

a pivot disposed between and interconnecting a first portion of said vibratory member including said distal end portion and a second portion of said vibratory member extending from said transducer body, wherein said pivot defines a rotational axis that is at least partially transverse to said long axis.

11. The transducer of claim 10, wherein said first driver is adapted to rotate said distal end portion about said rotational axis.

12. The transducer of claim 1, wherein at least a portion of said first driver is disposed within said transducer body.

13. An implantable hearing aid transducer, comprising:

a transducer body;

a vibratory member moveable relative to said transducer body for stimulating an auditory component; and a driver for selectively driving said vibratory member along at least one of first and second substantially transverse directions in response to transducer drive signals.

14. The transducer of claim 13, wherein said vibratory member further comprises:

a portion adapted for physical interconnection with said auditory component.

15. The transducer of claim 13, wherein said vibratory member further comprises a first component for magnetically engaging a second component attached to an auditory component of a patient.

16. The transducer of claim 15, wherein said first component comprises one of a magnet and a coil and said second component comprises one of a coil and a magnet, respectively.

17. The transducer of claim 13, wherein said vibratory member comprises an elongated actuator having a distal end for stimulating said auditory component and wherein a long axis of said actuator defines said first direction.

18. The transducer of claim 17, wherein the transducer body includes an aperture extending through at least a first side thereof, and wherein said elongated actuator is advanceable along said long axis through said aperture.

19. The transducer of claim 17, wherein said distal end supports said driver.

20. The transducer of claim 13, wherein said driver comprises:

a first driver for driving said vibratory member in said first direction; and a second driver for driving said vibratory member in said second direction.

21. The transducer of claim 13, wherein said vibratory member is pivotally interconnected to said transducer body, and wherein said driver is operative to apply a moment to said vibratory member.

22. The transducer of claim 13, wherein said transducer body is adapted for fixed positioning relative to tissue of a patient.

23. An implantable hearing aid transducer, comprising:

a transducer body adapted for fixed positioning relative to a skull of a patient;

a vibratory member extending from the transducer body along a first axis and having a distal end;

a first driver suspended proximate to said distal end for displacing said distal end of said vibratory member along a movement path in response to transducer drive signals, wherein said movement path has a component that is at least partially transverse to said first axis; and a second driver for displacing said distal end of said vibratory member in a direction along said first axis, wherein said second driver is disposed proximate to a proximal end of said vibratory member.

24. The implantable transducer of claim 23, wherein said first driver is adapted to physically engage an auditory component of a patient.

25. A hearing aid comprising:

an acoustic signal receiver to receive acoustic sound and generate acoustic response signals;

a signal processor to process the acoustic response signals to generate transducer drive signals;

an implantable transducer to process the transducer drive signals and stimulate a middle ear component, the transducer comprising:

a transducer body;

a vibratory member moveable relative to said transducer body for stimulating an auditory component; and a driver for selectively driving said vibratory member along first and second substantially transverse directions of movement in response to transducer drive signals, wherein said driver comprises a first driver for driving said vibratory member in said first direction and a second driver for driving said vibratory member in said second direction.

26. The transducer of claim 13, wherein said first direction comprises a first movement path and said second direction comprises a second movement path.

* * * * *